US007333592B2

(12) United States Patent
Nonoguchi et al.

(10) Patent No.: US 7,333,592 B2
(45) **Date of Patent: *Feb. 19, 2008**

(54) X-RAY TUBE

(75) Inventors: Masahiro Nonoguchi, Tachikawa (JP); Masaru Kuribayashi, Akishima (JP)

(73) Assignee: Rigaku Corp., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/404,932

(22) Filed: Apr. 14, 2006

(65) Prior Publication Data

US 2006/0233308 A1 Oct. 19, 2006

(30) Foreign Application Priority Data

Apr. 19, 2005 (JP) ..... 2005-120760
Apr. 4, 2006 (JP) ..... 2006-102728

(51) Int. Cl.
*H01J 35/06* (2006.01)

(52) U.S. Cl. ..... 378/136; 378/137

(58) Field of Classification Search ..... 378/119, 378/136, 137, 139
See application file for complete search history.

(56) References Cited

U.S. PATENT DOCUMENTS 3,631,289 A 12/1971 Perry
3,885,179 A * 5/1975 Friedel ..... 378/136
6,333,969 B1 * 12/2001 Kujirai ..... 378/138
6,356,619 B1 * 3/2002 Nagy et al. ..... 378/138
2005/0232396 A1 * 10/2005 Chidester ..... 378/136
2007/0090744 A1 4/2007 Kuribayashi et al.
2007/0092064 A1 * 4/2007 Kuribayashi et al. ..... 378/136

FOREIGN PATENT DOCUMENTS

JP 58-26144 A 6/1983
JP 63-232264 A 9/1988
JP 1-161547 U 11/1989
JP 05-242842 A 9/1993
JP 6-9047 U 2/1994
JP 10-334839 A 12/1998
JP 2001-297725 A 10/2001

* cited by examiner

*Primary Examiner*—Hoon Song
(74) *Attorney, Agent, or Firm*—Frishauf, Holtz, Goodman & Chick, P.C.

(57) ABSTRACT

An X-ray tube includes an electron gun in which a Wehnelt electrode is formed with an opening asymmetric about an electron emitter. The electron emitter is an elongate coil filament which is disposed inside the elongate opening of the Wehnelt electrode. The opening has two longer sides positioned asymmetrically about a center-of-width line of the filament. Each of the two longer sides is curved in the same direction as viewed in a direction normal to the front face of the Wehnelt electrode. The two longer sides have curvature radii R1 and R2 different from each other, so that an electron-beam-irradiation region on a target is not curved but becomes almost straight.

5 Claims, 12 Drawing Sheets

X-RAY TUBE

BACKGROUND OF THE INVENTION

1. Field of the Invention

The present invention relates to an X-ray tube having a characteristic electron gun.

2. Description of the Related Art

An X-ray tube includes an electron gun with a typical structure in which a Wehnelt electrode is formed with an opening inside which a coil filament is disposed. The coil filament emits an electron beam which is narrowed by an electric field made by the Wehnelt electrode to make a specified electron-beam-irradiated region on a target, so that the irradiated region generates X-rays. The electron-beam-irradiation region emits not only X-rays but also metal atom ions, i.e., positive ions, the metal atom making up the target material. The ions may occasionally collide with the filament. When the filament experiences the ion bombardment, the filament is subject to erosion disadvantageously, resulting in a shorter lifetime of the filament.

Then, there have been known the countermeasures in which the position of the filament is shifted from the position facing the electron-beam-irradiation region so that the filament experiences the ion bombardment as little as possible. FIG. 1 shows in section such an eccentric filament configuration. FIG. 1 shows a condition in which an electron gun 12 faces a revolving target 10 (i.e., rotating anode). The electron gun 12 includes a Wehnelt electrode 14 and a coil filament 16 which is disposed inside an opening 18 formed in the Wehnelt electrode 14. The opening 18 and the filament 16 extends long in a direction perpendicular to the drawing sheet. A line 22, which passes through the center-of-width of the filament 16 and yet is perpendicular to the front face 20 of the Wehnelt electrode 14, is referred to as a filament center extension line hereinafter. The eccentric filament configuration has a feature that the center-of-width of the electron-beam-irradiation region on the target 10 is deviated from the filament center extension line 22 by a distance D which is about a half width of the filament 16. In other words, the opening 18 of the Wehnelt electrode 14 is formed asymmetric about the center-of-width of the filament 16 so that the electron beam 24 can be deviated as described above. A distance A between the filament center extension line 22 and one longer side 26 (which extends in a direction perpendicular to the drawing sheet) of the opening 18 is different from another distance B between the filament center extension line 22 and the other longer side 28 (which also extends in a direction perpendicular to the drawing sheet) of the opening 18, the distance A being shorter than the distance B. Accordingly, the electric field made by the Wehnelt electrode 14 affects the electron beam 24 asymmetrically, so that the electron beam 24 is deflected downward as shown in FIG. 1, resulting in the deviation of the electron-beam-irradiation region by the distance D as described above.

FIG. 3 shows a positional relationship between the opening 18 of the Wehnelt electrode and the filament 16. The opening 18 and the filament 16 each has an elongate shape as a whole. The distance A between the center-of-width line 34 of the filament 16 and one longer side 26 of the opening 18 is different from the distance B between the center-of-width line 34 and the other longer side 28, the longer sides 26 and 28 being straight lines.

In the field of the X-ray tube, the electron gun with the eccentric filament configuration is known and disclosed in, for example, Japanese patent publication No. 5-242842 A (1993), which is referred to as the first publication, and Japanese patent publication No. 2001-297725 A, which is referred to as the second publication.

The first and second publications each relates to a structure having a combination of a couple of the eccentric filaments and discloses the formation of an opening asymmetric about the filament so as to deviate the electron-beam-irradiation region on the target from the above-mentioned filament center extension line.

The inventors of the present invention have found out that the electron gun with the eccentric filament configuration gives rise to a curved electron-beam-irradiation region on the target. FIG. 8A shows the shape of the curved electron-beam-irradiation region as viewed from the left side of FIG. 1. The electron beam is narrowed and deviated downward as shown in FIG. 1 so that the electron-beam-irradiation region 30 is curved with a downward convex shape as shown in FIG. 8A. Denoting the length of the elongate electron-beam-irradiation region 30 by a symbol L and the width by a symbol W, the length L is 8 millimeters and the width W is 0.4 millimeter for example. Assuming that one end of the width (the upper end in FIG. 8A) at one end of the length of the elongate electron-beam-irradiation region 30 is connected by a line segment 32 with similar one end of the width at the other end of the length, the maximum distance between the line segment 32 and the curved longer side is defined as a curvature amount which is denoted by a symbol $\Delta W$. The curvature amount $\Delta W$ is divided by the width W of the electron-beam-irradiation region 30 to get a value $\Delta W/W$ which is defined as a curvature coefficient. In the case of the conventional shape of the opening 18 shown in FIG. 3, the electron-beam-irradiation region 30 is curved as described above and its curvature coefficient is about 0.02 for example.

The curved electron-beam-irradiation region would give rise to some problems described below. FIG. 10A is a perspective view showing an X-ray optical system in which a line focus 52 emits an X-ray beam 54 which is reflected by an X-ray reflecting mirror 56 made of a synthetic multilayer film and then irradiates a sample 58. It should be noted that although the optical system uses an elliptic mirror to get a focused X-ray beam, a parabolic mirror may be used to get a parallel X-ray beam. When the X-ray optical system uses such an X-ray reflecting mirror, it is very important to keep the linearity in shape of the line focus 52. A positional relationship between the X-ray reflecting mirror 56 and the line focus 52 must be exactly determined so that an X-ray beam 60 with a sufficient intensity can be taken out from the X-ray reflecting mirror 56. It is important in this case to exactly keep the predetermined positional relationship between the X-ray reflecting mirror 56 and the line focus 52 at any longitudinal position on the line focus 52. If the linearity in shape of the line focus 52 is kept with a high degree of accuracy, the positional relationship with the X-ray reflecting mirror 56 is constant at any longitudinal position on the line focus 52, so that an X-ray beam 60 with a sufficient intensity can be taken out.

On the contrary, if the line focus 53 is curved as shown in FIG. 10B, even though the longitudinal midpoint of the line focus 53 has been exactly positioned with the predetermined positional relationship with the X-ray reflecting mirror 56, the longitudinal ends of the line focus 53 would be misaligned with the predetermined positional relationship. As a result, even though an X-ray beam 62 with a sufficient intensity is obtained from the vicinity of the longitudinal midpoint of the line focus 53 through the X-ray reflecting mirror 54, an X-ray beam 64 from the vicinities the longitudinal ends of the line focus 53 through the X-ray reflecting mirror 54 would have a lower intensity than from the vicinity of the longitudinal midpoint. Since the degree of accuracy in positioning between the X-ray reflecting mirror and the X-ray source strongly affects an intensity of an X-ray which is taken out from the X-ray reflecting mirror, the linearity in shape of the line focus (i.e., the degree of curvature) would strongly affect an X-ray intensity from the X-ray reflecting mirror.

Since the shape of the line focus corresponds to the shape of the electron-beam-irradiation region on the target, it is very important to make the curvature coefficient of the elongate electron-beam-irradiation region as small as possible in the X-ray optical system using the X-ray reflecting mirror. If an X-ray beam from the X-ray source irradiates a sample directly, the curvature coefficient of about 0.1 for example would almost always have no problem. On the other hand, if using the X-ray reflecting mirror, the curvature coefficient of about 0.1 would have a problem that an X-ray intensity from the X-ray reflecting mirror would be reduced by about ten percent as compared with the case using the linear line focus. Accordingly, when using the X-ray reflecting mirror, the curvature coefficient of the electron-beam-irradiation region should be as small as possible, not greater than 0.01 being preferable. However, when adopting the above-described eccentric filament configuration, the curvature coefficient of the electron-beam-irradiation region would become about 0.02 disadvantageously with no countermeasure in the shape of the opening of the Wehnelt electrode, so that there is a problem with a reduced X-ray intensity which is taken out from the X-ray reflecting mirror

SUMMARY OF THE INVENTION

It is an object of the present invention to provide an X-ray tube including an electron gun-having a Wehnelt electrode formed with an opening which is asymmetric about an electron emitter, with an advantage that an electron-beam-irradiation region on a target is not curved as far as possible.

An X-ray tube according to the present invention includes (i) an electron gun having (i-a) a Wehnelt electrode formed with an elongate opening and (i-b) an elongate electron emitter disposed inside the opening and (ii) a target which is irradiated with an electron beam emitted from the electron gun to generate X-rays, the shape of the opening of the Wehnelt electrode being specially designed as described below. The opening has two longer sides positioned asymmetrically about a center-of-width line of the electron emitter. Each of the two longer sides is curved in a same direction as viewed in a direction normal to a front face of the Wehnelt electrode. As a result, the electron-beam-irradiation region on the target is not curved but becomes almost linear.

Each of the two longer sides of the opening may have a shape consisting of a circular arc with a curvature radius which is different from a curvature radius of anothre longer side, so that the two curvature radii can be optimized to upgrade the linearity of the electron-beam-irradiation region. The circular arc may be replaced by a series of plural line segments approaching the circular arc.

The opening may have another shape, that is, the opening has two longer sides positioned asymmetrically about a center-of-width line of the electron emitter, and the two longer sides are curved in opposite directions relative to each other as viewed in a direction which is parallel to a front face of the Wehnelt electrode and yet perpendicular to a longitudinal direction of the opening.

The shape of the opening is expressible with another expression, that is, (i) the opening has two longer sides positioned asymmetrically about a center-of-width line of the electron emitter, (ii) an electron-beam-irradiation region on the target has an elongate shape, and (iii) each of the two longer sides has a shape consisting of a curved line or a series of plural line segments approaching the curved line so that the electron-beam-irradiation region has a curvature coefficient being not greater than 0.01.

The present invention has an advantage that, in the X-ray tube including an electron gun having a Wehnelt electrode formed with an opening which is asymmetric about an electron emitter, the electron emitter can hardly experience the ion bombardment from the target and yet the electron-beam-irradiation region on the target has almost no curvature.

DETAILED DESCRIPTION OF THE PREFERRED EMBODIMENTS

Figure 1:
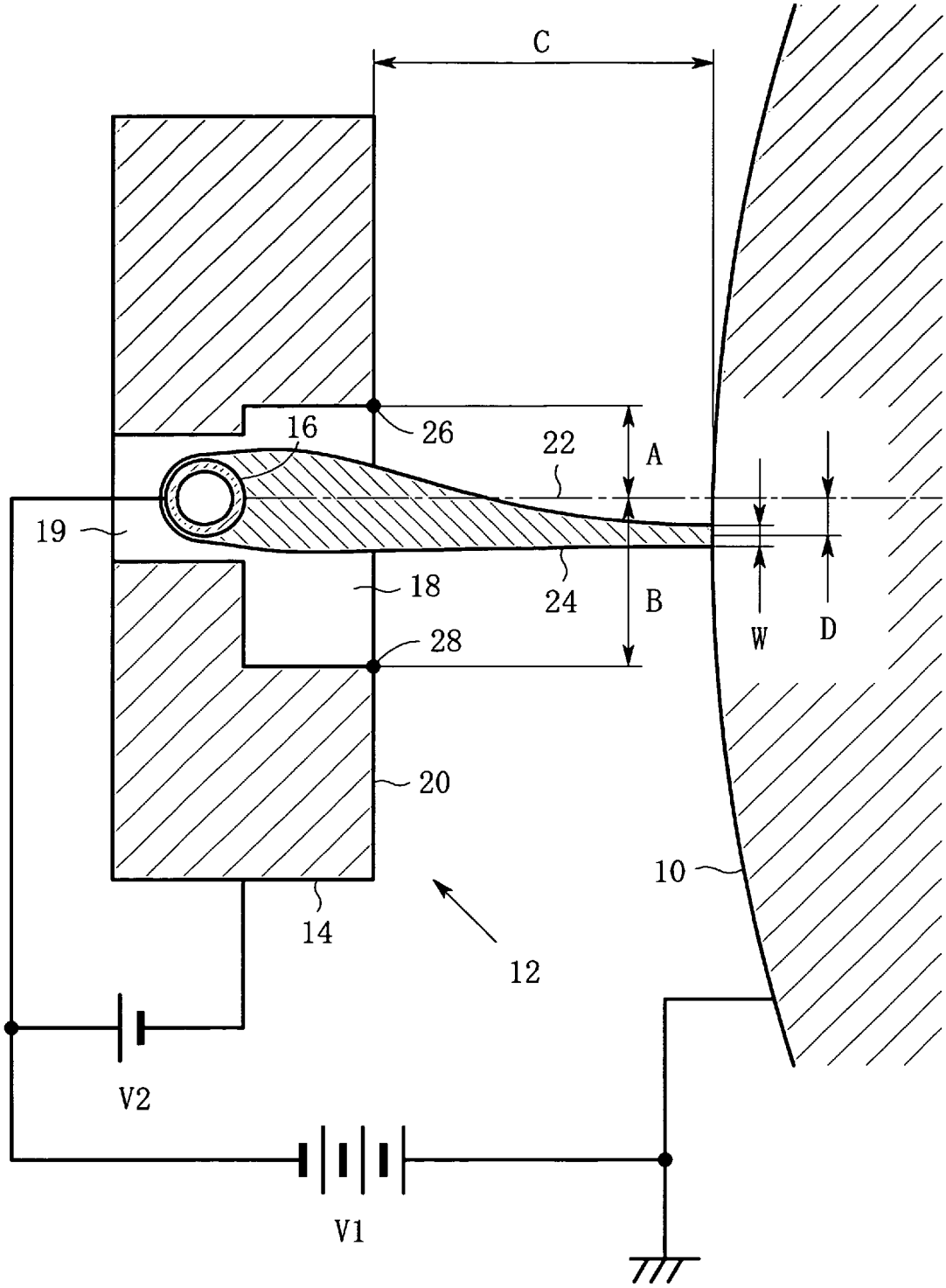
FIG. 1 is a sectional view showing the eccentric filament configuration.
Figure 2:
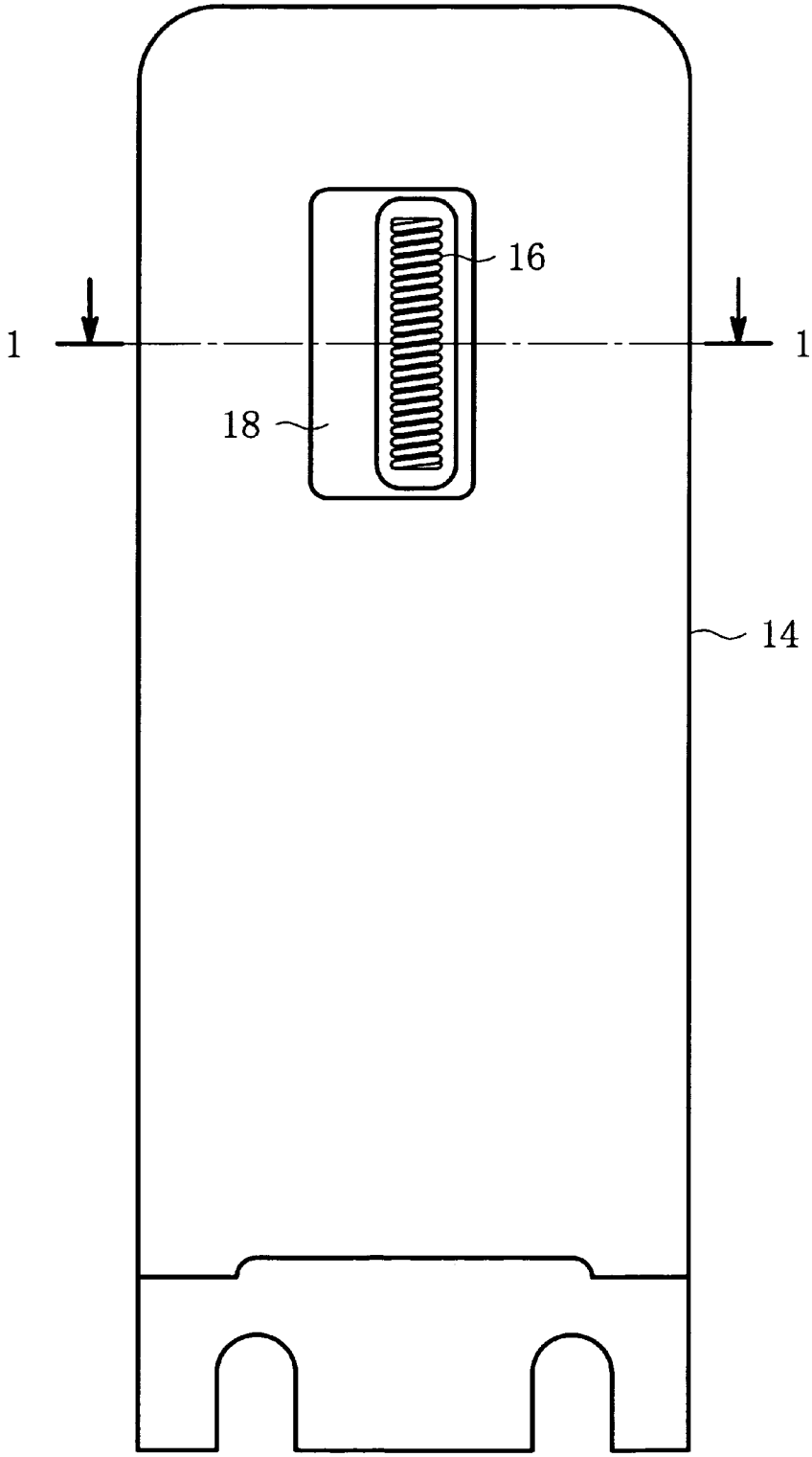
FIG. 2 is a front view showing a basic shape of the electron gun with the eccentric filament configuration.
Figure 3:
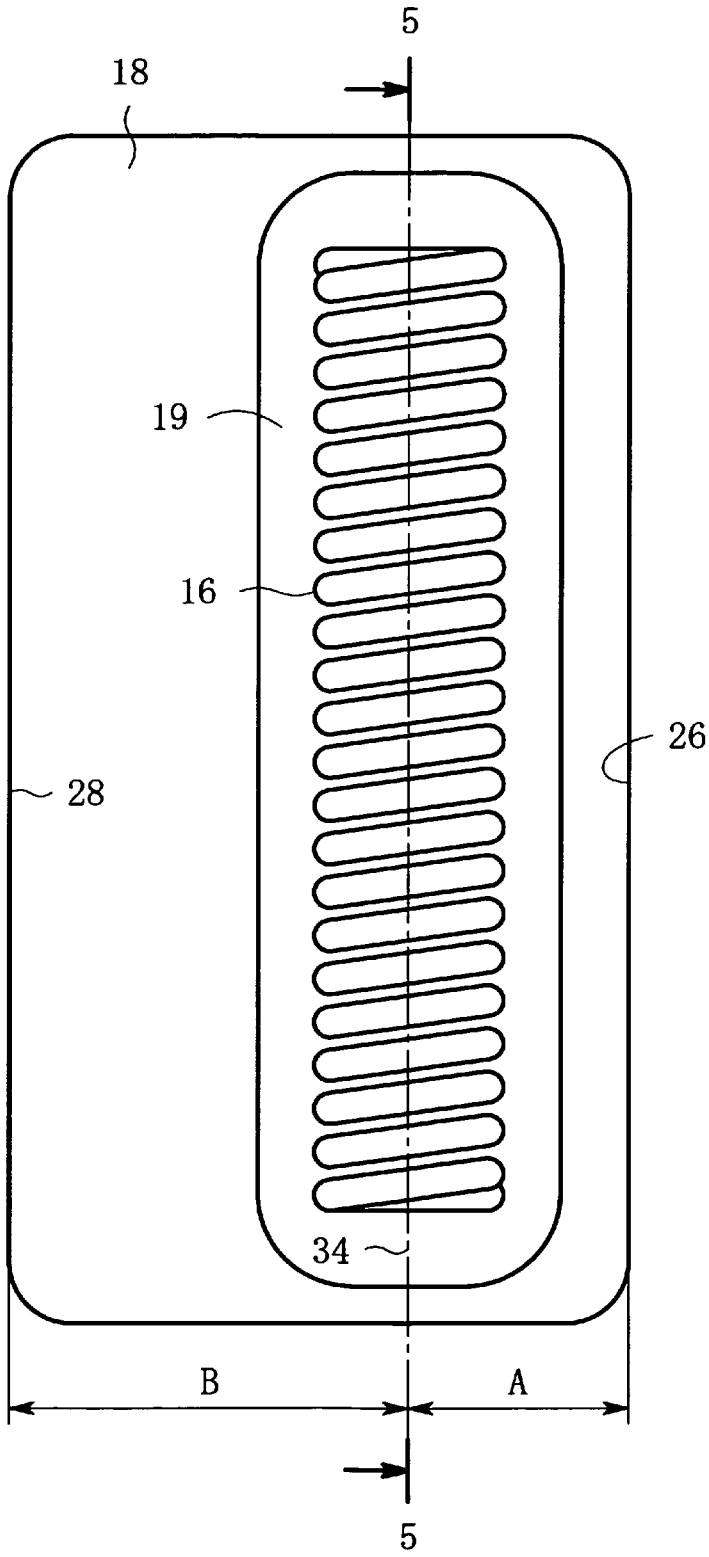
FIG. 3 is an enlarged view showing the opening of the Wehnelt electrode.

Embodiments of the present invention will now be described in detail below with reference to the drawings. Referring to FIG. 2 which is a front view showing a basic shape of the electron gun with the eccentric filament configuration, a Wehnelt electrode 14 is formed with an elongate opening 18 inside which an elongate coil filament 16 is disposed, the coil filament 16 corresponding to an electron emitter in the present invention. The sectional view of the electron gun 12 shown in FIG. 1 is a view taken along line 1-1 in FIG. 2. Referring to FIG. 3 which is an enlarged view showing the opening 18 of the Wehnelt electrode, the opening 18 has an elongate rectangular shape as a whole and has two longer sides 26 and 28. The opening 18 communicates with a filament reception room 19 which has an rectangular shape smaller than the opening 18 as viewed from the front of the Wehnelt electrode. The filament reception room 19 is, as shown in FIG. 1, positioned downward by a certain distance from the front face 20 of the Wehnelt electrode 14. Referring back to FIG. 3, a distance between one longer side 26 of the opening 18 and the center-of-width line 34 of the filament 16 is denoted by a symbol A while a distance between the other longer side 28 and the center-of-width line 34 is denoted by a symbol B, the distance B being larger than the distance A.

In the embodiment, the coil of the filament 16 has an outer diameter of 2.4 millimeters and the filament 16 has a length of 10.5 millimeters. The measure of the opening 18 is 16 millimeters long and 8.2 millimeters wide as viewed from the front of the Wehnelt electrode (i.e., as viewed in a direction normal to the front face), while the filament reception room 19 is 15 millimeters long and 4 millimeters wide. The distance A is 2.9 millimeters while the distance B is 5.3 millimeters.

Referring to FIG. 1, a negative high voltage V1 (i.e., an acceleration voltage) is supplied to the filament 16 relative to the target 10, while a negative bias voltage V2 is supplied to the Wehnelt electrode 14 relative to the filament 16. In this embodiment, for example, the acceleration voltage V1 is 45 kV and the bias voltage V2 is 200 V. A distance C between the front face 20 of the Wehnelt electrode 14 and the surface of the target 10 is 10.5 millimeters. The eccentric distance D becomes about 1.2 millimeters under the condition, the value being equal to about a half of the coil diameter of the filament 16.

Figure 4:
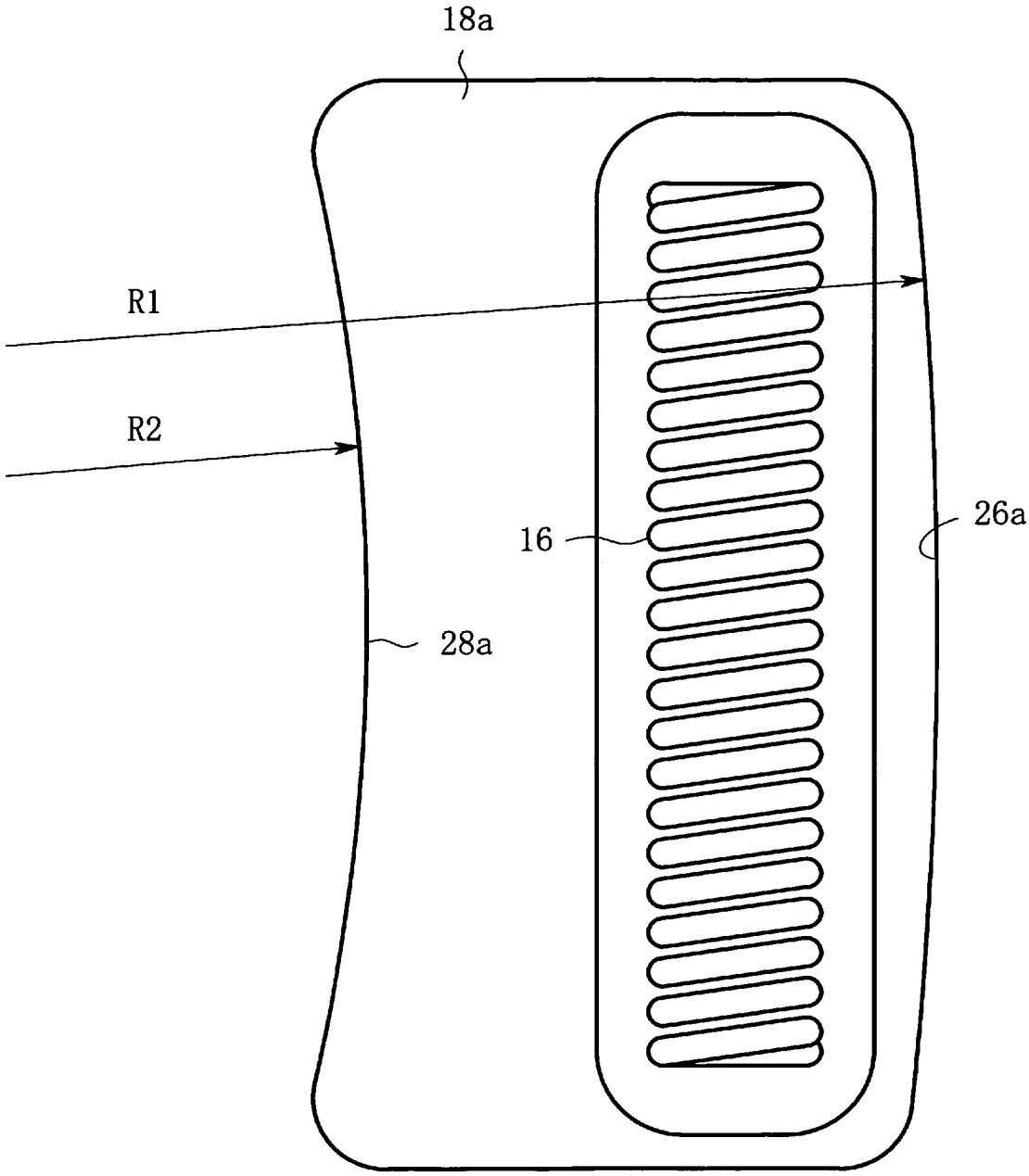
FIG. 4 shows the shape of an opening of the Wehnelt electrode in the first embodiment of the X-ray tube according to the present invention.
Figure 8A:
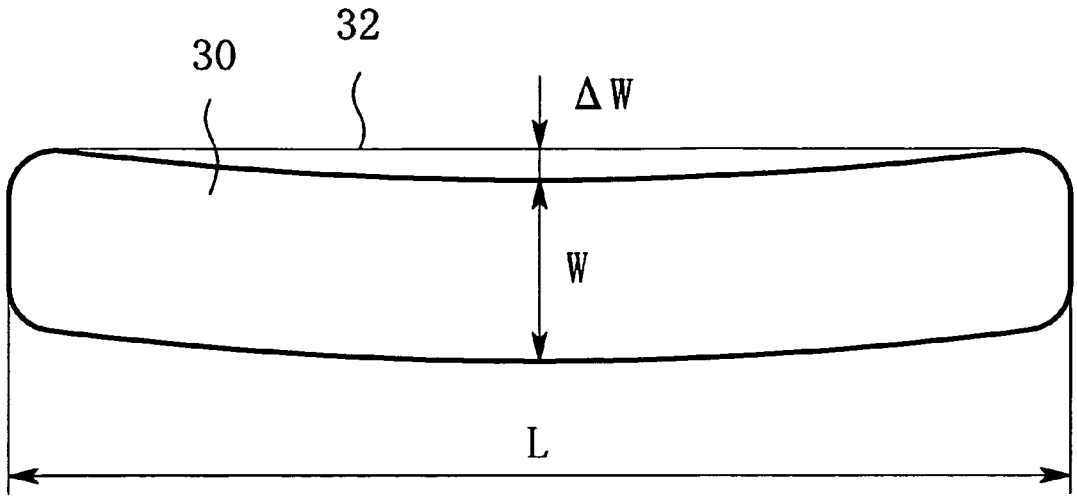
FIGS. 8A and 8B are illustrations showing two shapes of the electron-beam-irradiation region.
Figure 8B:
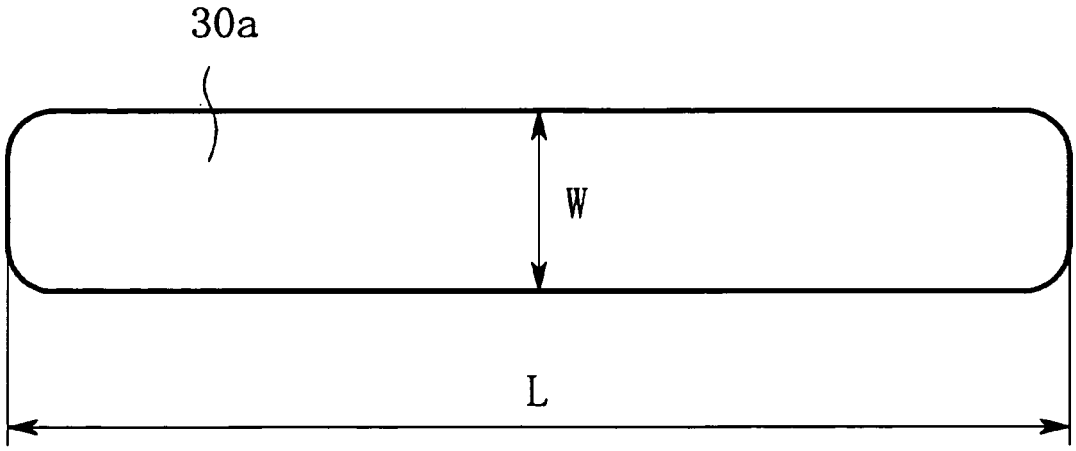

FIG. 3 shows the conventional shape of the opening 18 of the Wehnelt electrode in the eccentric filament configuration. The present invention is characterized to improve the shape of the opening 18. FIG. 4 shows the shape of an opening of the Wehnelt electrode in the first embodiment of the X-ray tube according to the present invention, as viewed in a direction normal to the front face of the Wehnelt electrode. The opening 18*a* has an elongate rectangular shape as a whole and has two longer sides 26*a* and 28*a* made of circular arcs which are curved in the same direction. The one longer side 26*a* is curved with a curvature radius R1 while the other longer side 28*a* is curved with another curvature radius R2. With the curved longer sides of the opening, the electron-beam-irradiation region on the target becomes almost straight. In this embodiment, R1 is 150 millimeters and R2 is 64.7 millimeters. FIG. 8B shows the shape of the electron-beam-irradiation region 30*a* made by the electron gun having the opening 18*a* shown in FIG. 4, in which W is 0.43 millimeter and L is 6.35 millimeters. It is noted that the shape of the electron-beam-irradiation region 30*a* has been determined by measurement of the focus shape of an X-ray beam which was generated from the electron-beam-irradiation region.

Figure 6:
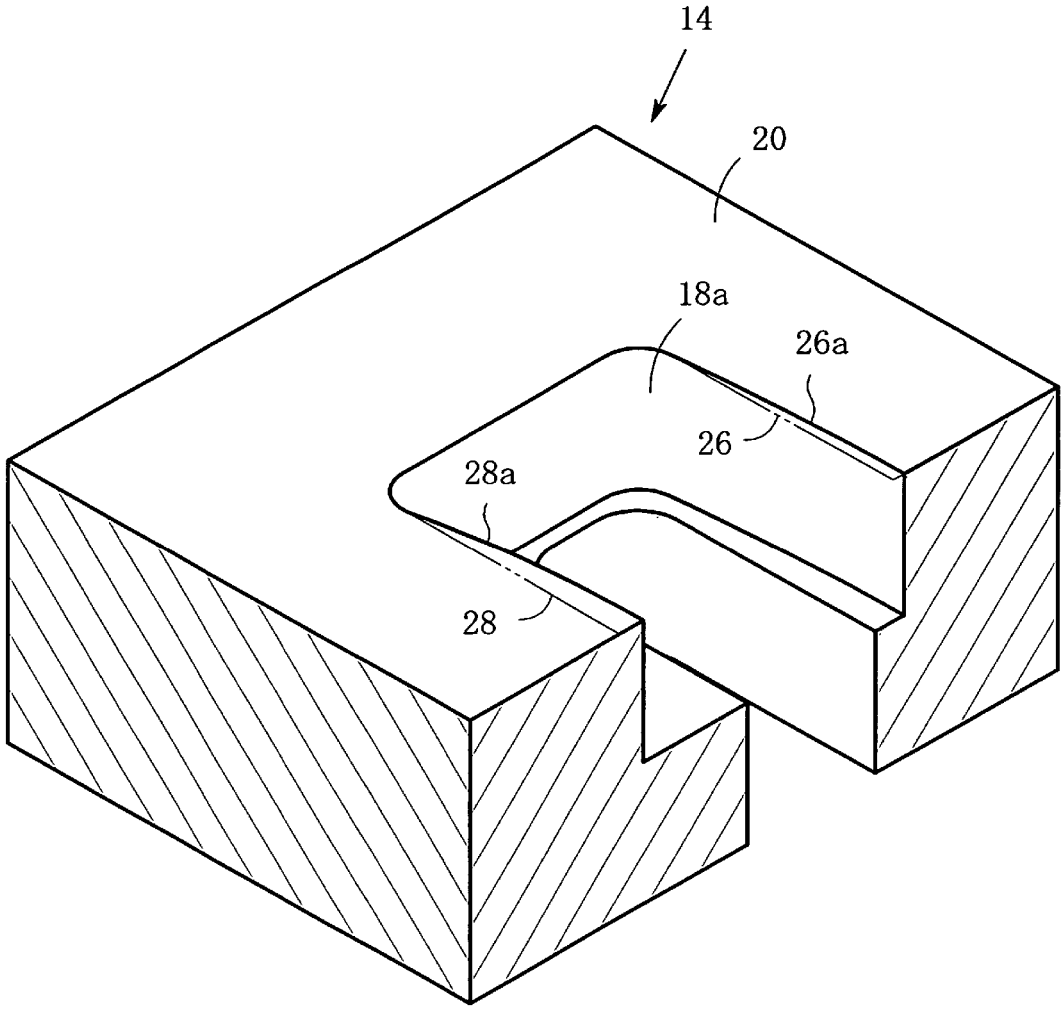
FIG. 6 is a perspective view showing a part of the opening shown in FIG. 4.

FIG. 6 is a perspective view showing a part of the opening shown in FIG. 4, a part of the Wehnelt electrode being cut out and being shown in section at the longitudinal midpoint of the opening 18*a*. The Wehnelt electrode 14 has a flat front face 20. The opening 18*a* has two longer sides 26*a* and 28*a* which are curved as compared with the conventional longer sides 26 and 28, which are depicted by imaginary lines, of the conventional opening 18 shown in FIG. 3.

Figure 9:
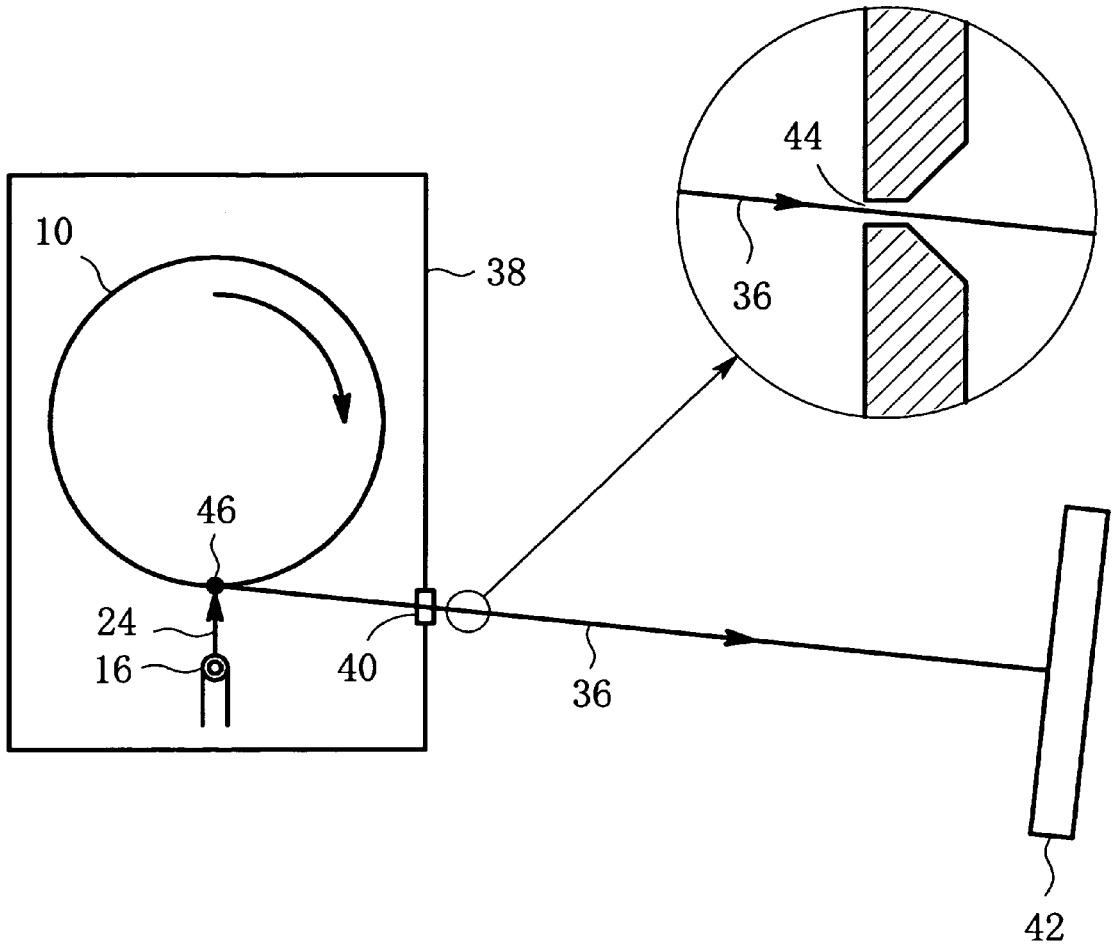
FIG. 9 is a plan view showing the principle of measurement of the shape of the electron-beam-irradiation region.
Figure 10A:
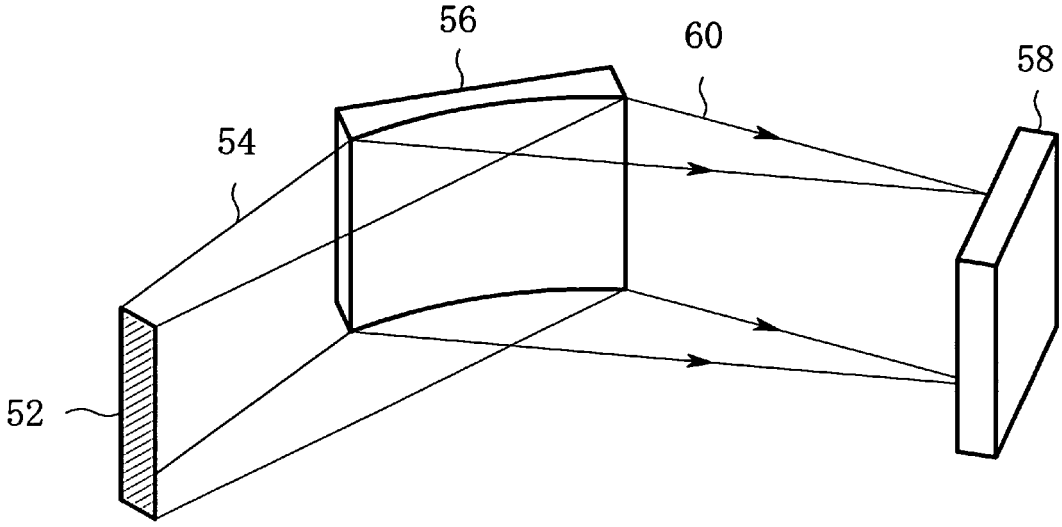
FIGS. 10A and 10B are perspective views showing a problem with a curved line focus.
Figure 10B:
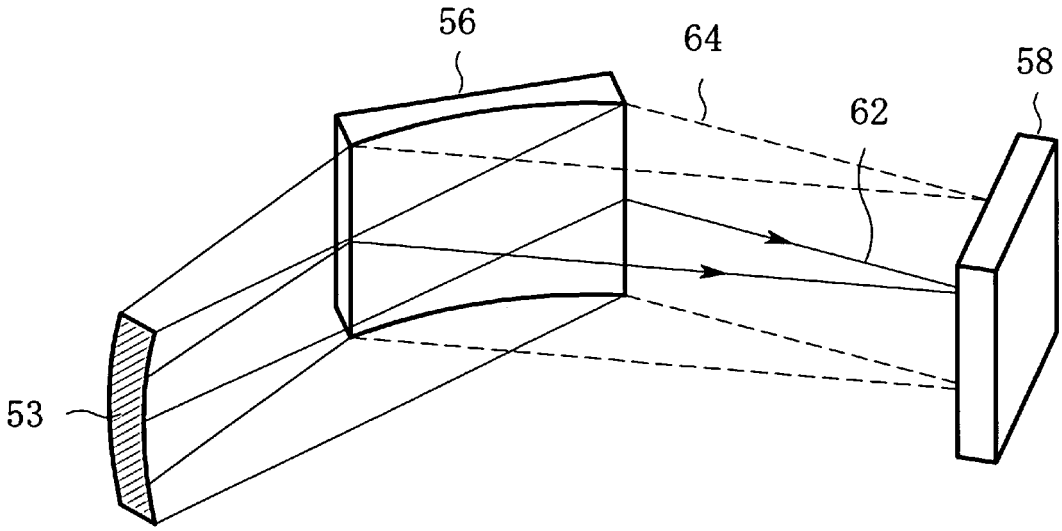

Next, there will be described a method for determining the optimum curvature radii of the two longer sides of the opening. Referring to FIG. 9 which is a plan view showing the principle of measurement of the shape of the electron-beam-irradiation region, a filament 16 (which extends long in a direction perpendicular to the drawing sheet) emits an electron beam 24 which irradiates the surface of the rotating target 10 to generate an X-ray beam 36 which is taken out from a window 40 of an X-ray tube 38 to be detected by a two-dimensional X-ray detector 42, which is a semiconductor X-ray detector consisting of CMOS devices in this embodiment. Soon after the window 40 is arranged a pinhole 44 with which a pinhole photograph of the shape of the X-ray focus 46 on the target 10 can be taken by the two-dimensional X-ray detector 42, the pinhole size being ten micrometers. A distance between the X-ray focus 46 and the pinhole 44 is 70 millimeters while a distance between the pinhole 44 and the two-dimensional X-ray detector 42 is 630 millimeters, so that there can be taken a pinhole photograph with a ninefold magnification. FIG. 8B shows a thus-obtained shape of the X-ray focus. By the way, an X-ray intensity is not uniform within the shape of the X-ray focus on the target but has a specific distribution in which an X-ray intensity is decreased as the position approaches edges of the shape. Under the circumstances, the boundary of the shape of the X-ray focus is defined as the line on which an X-ray intensity is equal to a half of the maximum intensity.

The curved shapes of the two longer sides of the opening of the Wehnelt electrode can be determined so that the electron-beam-irradiation region can have a shape with almost no curvature or a linear shape as shown in FIG. 8B, the shape of the electron-beam-irradiation region being measured with the method shown in FIG. 9. Many openings with various curvature radii may be formed and tested with the method shown in FIG. 9 to determine the optimum pair of curvature radii. Alternatively, the inventors carried out not measurements for various curvature radii but theoretical calculations for the shapes of the electron-beam-irradiation region to determine the optimum pair of curvature radii, and thereafter the inventors actually made the opening with such optimum curvature radii and carried out the measurement shown in FIG. 9. The resultant values were above-described 150 millimeters in R1 and 64.7 millimeters in R2. It was confirmed that the calculated shape of the electron-beam-irradiation region was almost identical with the measured shape.

There will now be briefly explained a method of theoretical calculation. A finite element method is used to calculate an electric field in a space including the filament, the Wehnelt electrode and the target to further calculate a trajectory of a traveling electron which has been emitted from the filament, so that the shape of the electron-beam-irradiation region on the target can be obtained.

There will next be described calculation results for the curvature amount ΔW which is defined in FIG. 8A. The value ΔW/W was 0.022 for the opening shown in FIG. 3, that is, with the linear longer sides. The value ΔW/W was 0.0086 for the opening with 100 millimeters in R1 and 81.8 millimeters in R2, while ΔW/W was 0.0043 for the opening with 150 millimeters in R1 and 64.7 millimeters in R2.

Figure 5:
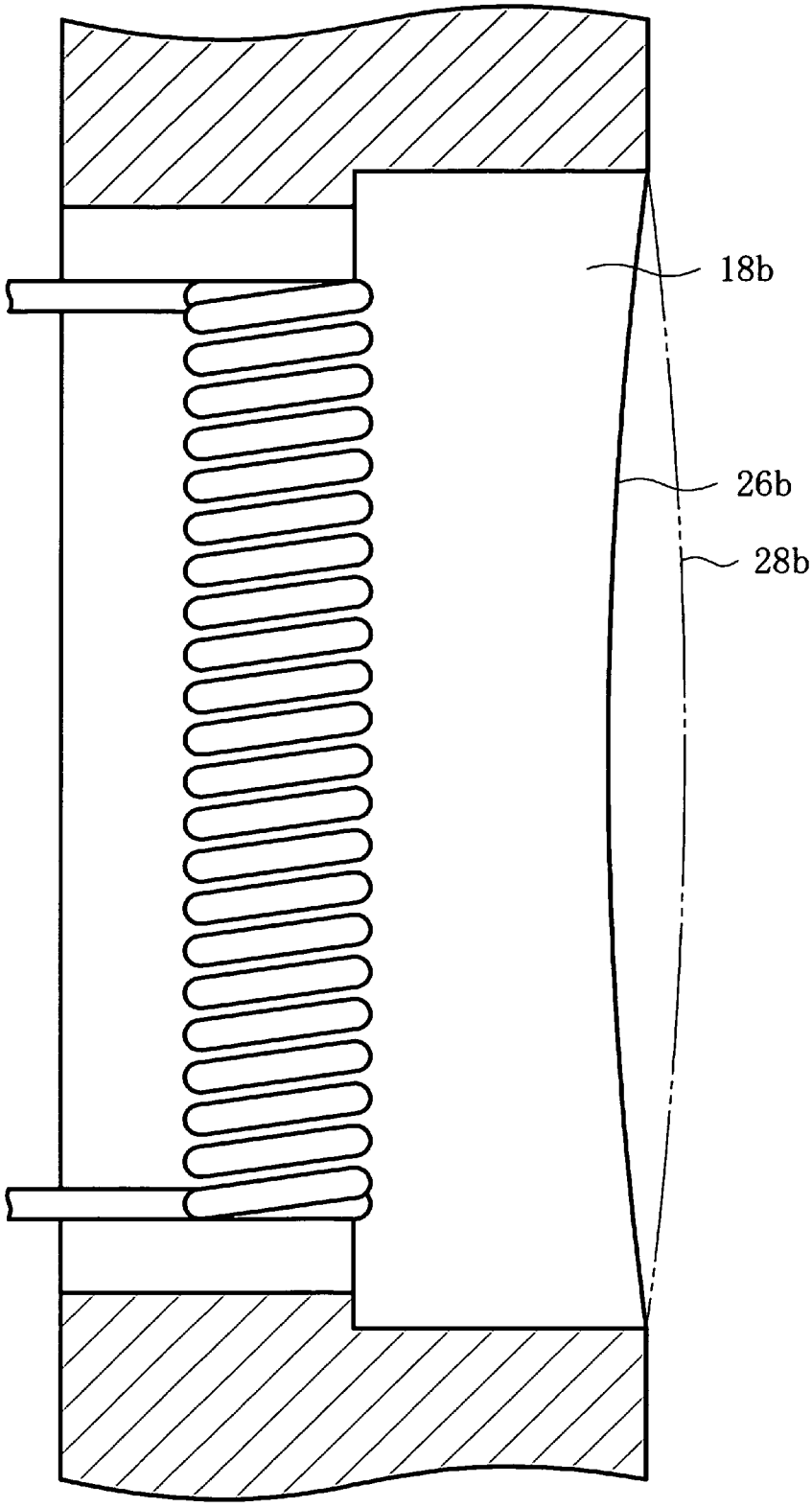
FIG. 5 is a sectional view showing an opening of the Wehnelt electrode in the second embodiment of the present invention.

Next, the second embodiment of the present invention will be described. FIG. 5 is a sectional view showing an opening of the Wehnelt electrode in the second embodiment of the X-ray tube according to the present invention. The shape of the opening in the second embodiment as viewed from the front is identical with the shape shown in FIG. 3. The two longer sides of the opening, however, are curved in a direction perpendicular to the front face of the Wehnelt electrode. FIG. 5 corresponds to a sectional view taken along the line 5-5 in FIG. 3 for the second embodiment. One longer side 26*b* of the opening 18*b* is curved in a manner that the center of the longer side is retracted downward as viewed from the front (i.e., as viewed from the right in FIG. 5) while the other longer side 28*b* is curved in a manner that its center is projected upward as viewed from the front. In other words, the two longer sides 26*b* and 28*b* of the opening are curved in opposite directions relative to each other as viewed "in a direction which is parallel to the front face of the Wehnelt electrode and yet perpendicular to a longitudinal direction of the opening", i.e., in a direction perpendicular to the drawing sheet of FIG. 5. Also with such curved longer sides, there can be obtained the electron-beam-irradiation region having an almost straight shape as shown in FIG. 8B. The optimum curvature radii can be determined also in the second embodiment by conducting the procedures similar to that in the first embodiment shown in FIG. 4.

Figure 7:
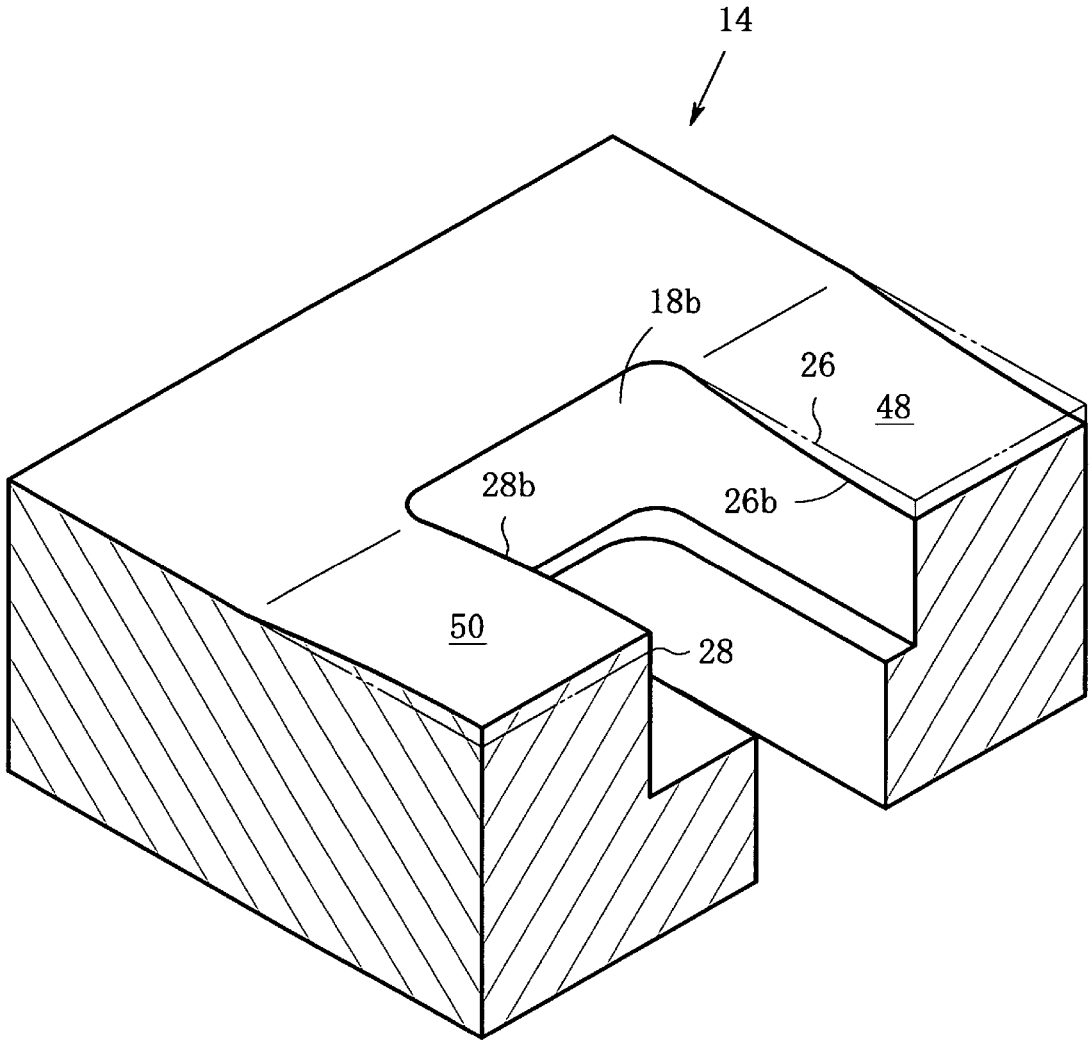
FIG. 7 is a perspective view, similar to FIG. 6, showing a part of the opening of the second embodiment shown in FIG. 5.

FIG. 7 is a perspective view, similar to FIG. 6, showing a part of the opening of the second embodiment shown in FIG. 5. The front face of the Wehnelt electrode 14 in the second embodiment is not flat but curved. The front face part 48 of the wehnelt electrode near one longer side 26*b* of the opening 18*b* is curved with a downward convex shape, while the front face part 50 of the wehnelt electrode near the other longer side 28*b* is curved with an upward convex shape, noting that the conventional longer sides 26 and 28 are depicted by imaginary lines.

Figure 11:
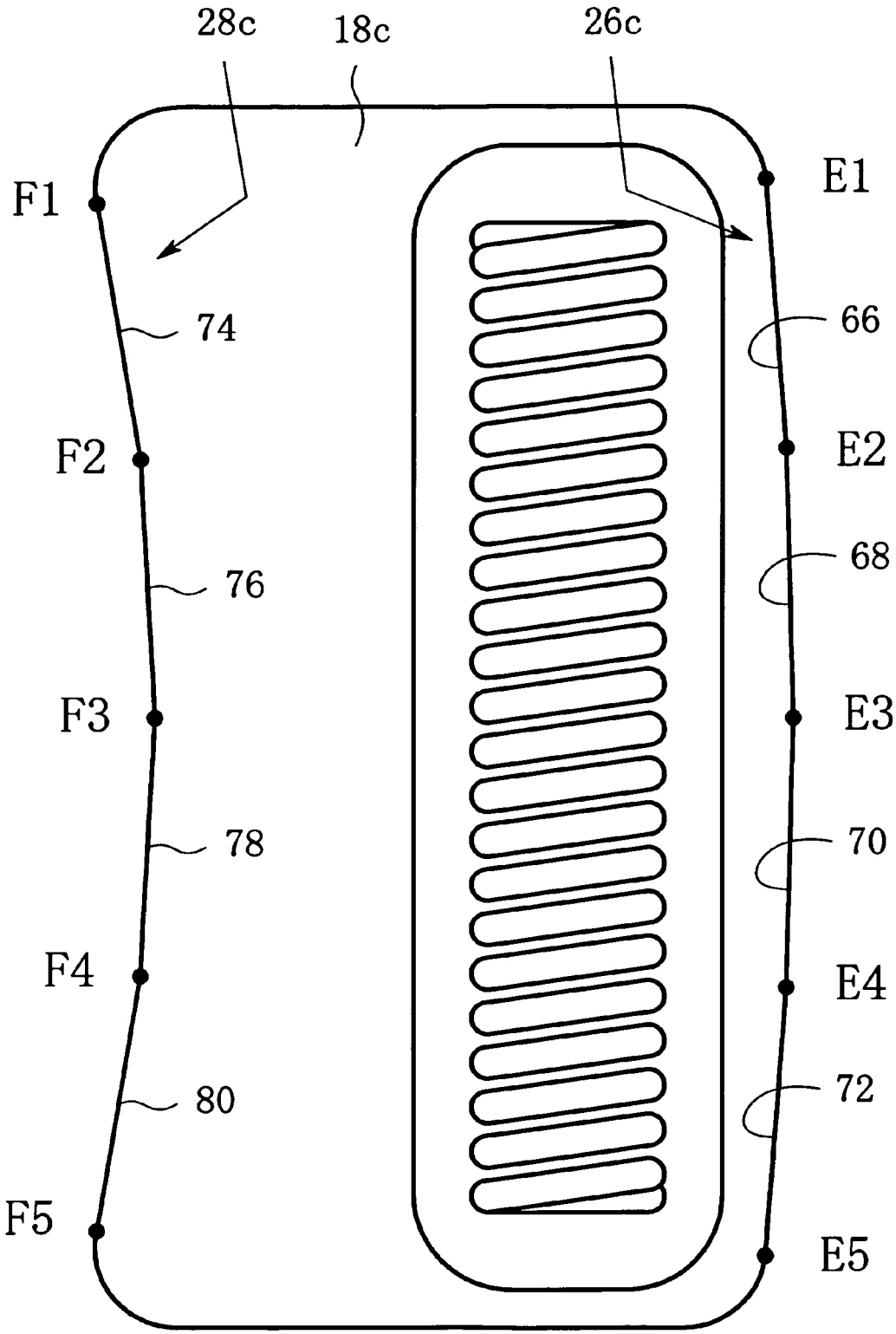
FIG. 11 shows the shape of an opening of the Wehnelt electrode in the third embodiment of the X-ray tube according to the present invention.

Next, the third embodiment of the present invention will be described. FIG. 11 shows the shape of an opening of the Wehnelt electrode in the third embodiment of the X-ray tube according to the present invention. One longer side 26*c* of the opening 18*c* has a shape consisting of a series of plural line segments approaching the circular-arc longer side 26*a* shown in FIG. 4. The longer side 26*a* shown in FIG. 4 has a shape consisting of a circular arc with a radius of 150 millimeters, while the longer side 26*c* shown in FIG. 11 has a shape consisting of a series of four line segments 66, 68, 70 and 72 approaching the circular arc, noting that the term "line segment" is defined as a finite part of a straight line. The circular arc is divided equally into four parts to get five boundary points (including two end points E1 and E5 and three division points E2, E3 and E4). The boundary points can be connected with one another by line segments to get four line segments 66, 68, 70 and 72. Similarly, the other longer side 28*c* has a shape consisting of a series of line segments approaching the circular-arc longer side 28*a* shown in FIG. 4, that is, a series of four line segments 74, 76, 78 and 80 approach the circular arc with a radius of 64.7 millimeters. Even with the series of plural line segments approaching the circular arc, the electron-beam-irradiation region on the target would be hardly curved as with the circular arc. The number of line segments may preferably be any one of four to eight.

Figure 12:
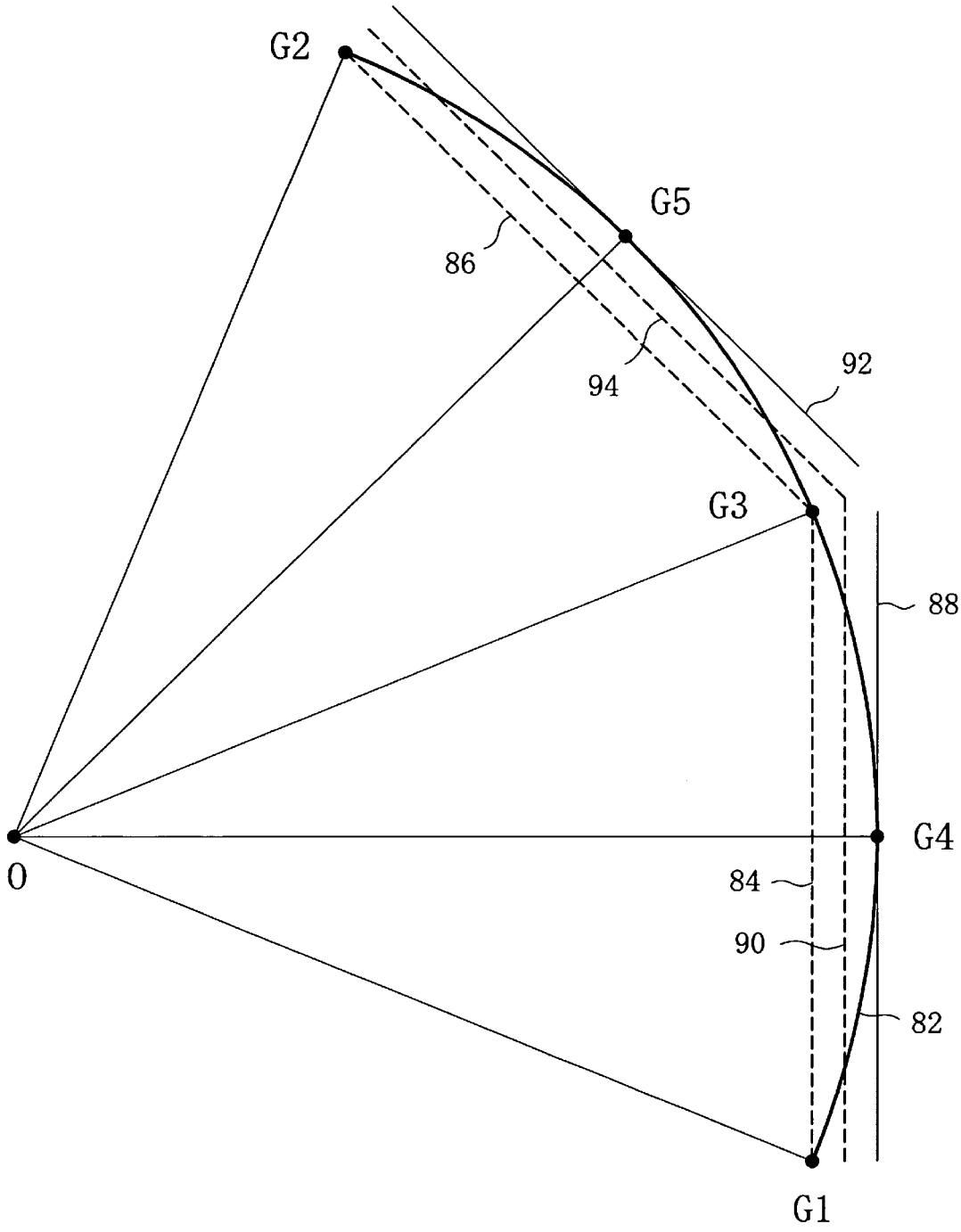
FIG. 12 is an illustration showing a method for making a series of plural line segments approaching a circular arc.

FIG. 12 is an illustration showing a method for making a series of plural line segments approaching a circular arc. There will now be explained, for example, that a circular arc 82 ranging between one end point G1 and the other end point G2 is divided equally into two line segments. The center of the circular arc 82 is the point O. First, the midpoint G3 is determined between the end points G1 and G2. Points G1 and G3 are connected to each other by a line segment 84 while points G3 and G2 are connected to each other by another line segment 86 to complete the simplest approaching method. Now, the circular arc G1-G2 has been approached by the two line segments 84 and 86, noting that the line segments 84 and 86 are positioned inside the circular arc 82. Alternatively, there may be used a more precise approaching method so that line segments can come closer to the circular arc as described below. The midpoint G4 is determined between points G1 and G3. A tangential line 88 to the circular arc 82 is drew at point G4. Another line segment 90 is drew at the midway between the tangential line 88 and the line segment 84 so as to be parallel to the tangential line 88. The resultant line segment 90 comes closer to the circular arc 82 than the line segment 84. Similarly, a similar tangential line 92 is drew at the midpoint G5 between points G3 and G2 and another midway line segment 94 is drew. Finally, the line segments 90 and 94 are connected to each other to approach the circular arc 82 by a series of the line segments 90 and 94 which is more precise than a series of the segments 84 and 86. The two longer sides 26*c* and 28*c* of the opening shown in FIG. 11 each also may have a shape consisting of a series of such more precise line segments.

It should be noted that although an X-ray tube in the above-described embodiments has a rotating target, the present invention is applicable to an X-ray tube having a stationary target, i.e., a fixed target.

What is claimed is:

1. An X-ray tube comprising:

an electron gun which includes a Wehnelt electrode formed with an elongate opening, and an elongate electron emitter disposed inside the openings; and a target which is irradiated with an electron beam emitted from the electron gun to generate X-rays, wherein the opening has two longer sides positioned asymmetrically about a center-of-width line of the electron emitter, and wherein each of the two longer sides is curved to have a center of curvature which is positioned at a same side of and away from the opening such that the two longer sides are curved in a same direction as viewed in a direction normal to a front face of the Wehnelt electrode.

2. An X-ray tube according to claim 1, wherein each of the two longer sides of the opening has a circular arc shape, and the two longer sides each have a different curvature radius.

3. An X-ray tube according to claim 1, wherein each of the two longer sides of the opening comprises a series of plural line segments approaching a circular arc, and the two longer sides each have a different curvature radius.

4. An X-ray tube comprising:

an electron gun which includes a Wehnelt electrode formed with an elongate opening, and an elongate electron emitter disposed inside the openings; and a target which is irradiated with an electron beam emitted from the electron gun to generate X-rays, wherein the opening has two longer sides positioned asymmetrically about a center-of-width line of the electron emitter, and wherein the two longer sides are curved in opposite directions relative to each other as viewed in a direction which is parallel to a front face of the Wehnelt electrode and perpendicular to a longitudinal direction of the opening.

5. An X-ray tube according to claim 4, wherein an electron-beam-irradiation region on the target has an elongate shape, and the two longer sides of the opening are curved so that the electron-beam-irradiation region has a curvature coefficient not greater than 0.01.

* * * * *